United States Patent [19]

Gershbein

[11] 4,300,578

[45] Nov. 17, 1981

[54] JEWELRY SMOKING DEVICE

[76] Inventor: George Gershbein, 30 W. 69th St., New York, N.Y. 10023

[21] Appl. No.: 38,290

[22] Filed: May 11, 1979

Related U.S. Application Data

[63] Continuation-in-part of Ser. No. 483,629, Jun. 27, 1974, Pat. No. 4,243,058.

[51] Int. Cl.[3] ..... A24F 5/10; A24F 1/32; A24F 3/00; A24F 1/22

[52] U.S. Cl. ..... 131/330; 131/186; 131/194; 131/205; 131/226; 131/229; 131/224; 131/258; 46/9; 63/1 R; 63/15.5

[58] Field of Search ..... 131/186, 205, 224, 229, 131/192, 171 R, 176, 258, 171 A, 170 A, 226, 194; 46/6-9; 63/1 R, 15.5

[56] References Cited

U.S. PATENT DOCUMENTS

| | | | |
|---|---|---|---|
| 595,801 | 12/1887 | Akeson | 131/192 |
| 605,142 | 6/1898 | Skenner | 131/186 |
| 645,399 | 3/1900 | King | 131/192 X |
| 1,307,978 | 6/1919 | Kline | 131/176 |
| 1,336,233 | 4/1920 | Ivory | 131/176 |
| 1,501,370 | 7/1924 | Ramsey | 131/186 UX |
| 2,224,660 | 12/1940 | Stubbs | 131/186 |
| 2,516,437 | 7/1950 | Weser | 131/258 X |
| 3,420,244 | 1/1969 | Rodgers et al. | 131/194 |
| 3,834,402 | 9/1974 | Paul | 131/194 |

FOREIGN PATENT DOCUMENTS

| | | | |
|---|---|---|---|
| 462603 | 1/1950 | Canada | 131/192 |

*Primary Examiner*—V. Millin

[57] ABSTRACT

Jewelry smoking devices are described which are in the form of ornamental pipe members suitable for being worn as items of jewelry. Each smoking device has a tobacco receiving portion for receiving smoking tobacco for the purpose of burning the same, and conduit means for carrying smoke from the tobacco receiving portion to a mouthpiece. The devices are in the general forms of pipe rings, pipe bracelets, and the like, and are decorative as well as being functional pipes which can be smoked as normal pipes are or while worn as items of jewelry.

11 Claims, 9 Drawing Figures

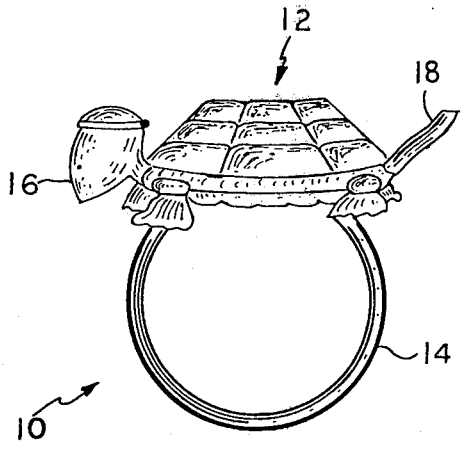
FIG. 1
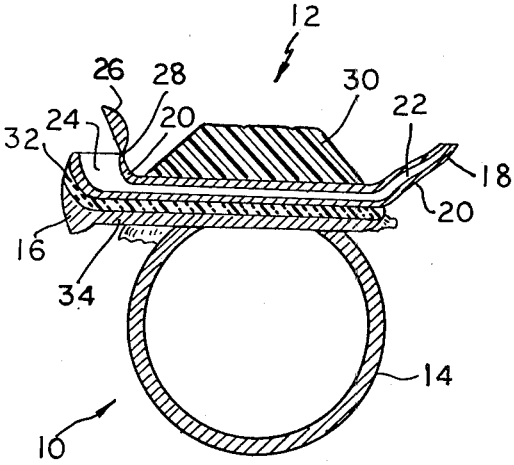
FIG. 2
FIG. 3
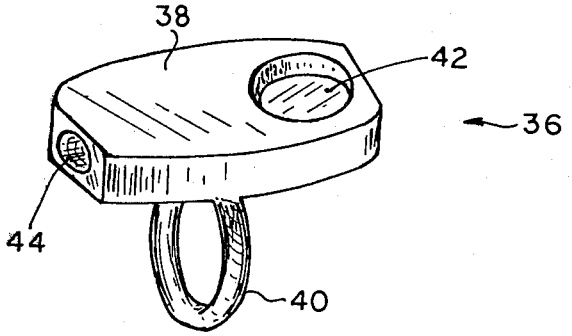
FIG. 4
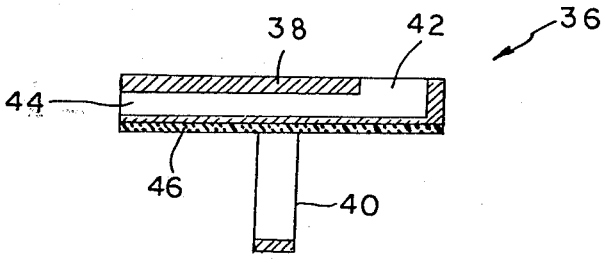
FIG. 5
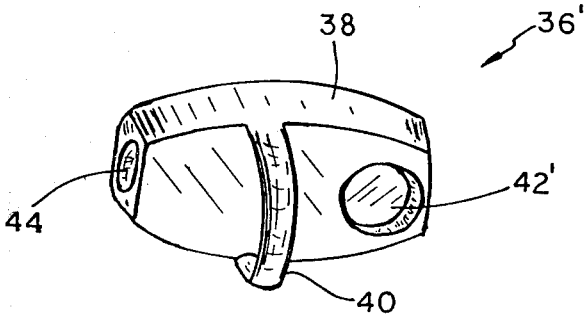

JEWELRY SMOKING DEVICE

CROSS-REFERENCE TO RELATED APPLICATION

This application is a continuation-in-part of Application Ser. No. 483,629, filed on June 27, 1974 now U.S. Pat. No. 4,243,058.

BACKGROUND OF THE INVENTION

The present invention generally relates to smoking devices, and more specifically to jewelry smoking devices which are decorative and can be smoked as normal pipes are or while worn as items of jewelry.

Various smoking devices are known. Of particular interest are pipes, which are normally handled only during the smoking process. Smoking pipes, which can be very simply decorated or very ornate, are frequently rested on pipe stands or racks when not in use. This is partially due to the bulky nature of pipes which frequently makes them inconvenient to be carried.

Cigarette and cigar holders are sometimes provided with means for holding the same during smoking. This may be in the form of a loop or handle adapted to receive a person's finger. However, this is not designed or intended to permit wear of the smoking device when not in use. Instead, the handles of the known type are intended to provide a better grip of the smoking device while the latter are in use. Means for providing a good grip is often necessary due to the large and bulky nature of the smoking device. However, such holding means are not associated with loose tobacco smoking pipes. For this reason, and because typical pipes are too large to be permanently worn, pipes in the form of decorative jewelry are not available or known in the prior art.

Prior art smoking devices did not permit concealment. Pipes such as shown in U.S. Pat. Nos. 595,801 and 1,501,370 were provided with lids or covers for covering the openings to the tobacco receiving compartments. These covers were, however, provided primarily for safety reasons and, irrespective of the positions of the covers, it was always very evident that the devices were smoking pipes. The reason for this is that the pipes in the aforementioned patents had conventional configurations or shapes and the covers likewise has conventional shapes. While the closing of the covers, therefore, covered the tobacco receiving openings, the cover and pipe configurations or exterior surfaces did not cooperate or blend with each other to conceal the nature or identity of the items. Cigarette holders, as opposed to pipes, are described in U.S. Pat. Nos. 2,224,660 and 2,516,437. While the cigarette holders are less conventionally shaped, they do not include covers, lids, plugs or other closure devices for covering the cigarette-receiving openings. Again, it is always evident, even under in close scrutiny, that the items are smoking devices in the nature of cigarette holders. In none of the prior art is there a movable member having an external surface configuration which, when closed, blends with the external surface of the rest of the pipe to camouflage or conceal, even under close scrutiny, the nature of the device.

SUMMARY OF THE INVENTION

Accordingly, it is an object of the present invention to provide a smoking device which does not have the above-described disadvantages.

It is another object of the present invention to provide a smoking device of the type suggested in the above object which is simple in construction and economical to manufacture.

It is still another object to provide smoking devices which can be permanently worn and include means for concealing the nature of the devices as smoking devices.

It is yet another object to provide pipe jewelry which can be smoked while the same is worn by the smoker.

It is a further object of the present invention to provide pipe jewelry which can be worn by a person as a normal item of jewelry and subsequently removed from the person for the purpose of smoking the same.

It is still a further object to provide pipe jewelry of the type under discussion which includes means for concealing the opening for receiving pipe tobacco to thereby enhance the ornamental appearance of the jewelry when the same is worn and not smoked.

It is yet a further object of the present invention to provide pipe jewelry which includes an ornamental portion and mounting means for permitting the ornamental portion to be worn as an item of jewelry.

It is an additional object to provide pipe jewelry as in the last object which includes means for interchanging the ornamental porions with respect to the mounting means.

It is yet an additional object to provide ornamental pipe jewelry which can be worn as a decorative item and which is functional to permit the same to be utilized as a loose tobacco smoking pipe.

It is still an additional object to provide pipe jewelry as in the last project which can assume the general form of rings, tie clasps, necklace pendants, bracelets, and the like.

In order to achieve the above objects, as well as others which will become apparent hereafter, the present invention for pipe jewelry comprises an ornamental pipe member adapted to be worn as an item of jewelry. The smoking device has a tobacco receiving portion for receiving smoking tobacco for the purpose of burning the same. A mouthpiece is provided as well as conduit means for carrying smoke from said tobacco receiving portion to said mouthpiece.

In a presently preferred embodiment, said pipe member includes an ornamental tobacco receiving portion, and support means for supporting the latter during wear of the smoking device. Said receiving portion may be interchangeably mounted on said support means. In this way, numerous receiving portions may be available for use with the same mounting means.

Said tobacco receiving portion has an access opening and the presently preferred construction includes cover means for selectively providing access to said opening and for concealing the same to enhance the aesthetic features of said ornamental pipe member.

Pipe jewelry of the type broadly described above can be in the form rings, tie clasps, necklace pendants, bracelets and the like. In each instance, the pipe jewelry item is ornamental and can be worn as an object of jewelry and is configurated and designed to be functional to permit the same to be utilized as a loose tobacco smoking pipe.

Where the item of pipe jewelry is of the type intended to be worn at the same time that it is being smoked, suitable insulation means is advantageously provided to protect the wearer from excessively high temperatures.

BRIEF DESCRIPTION OF THE DRAWINGS

With the above and additional objects and advantages in view, as will hereafter appear, this invention comprises the devices, combinations and arrangement of parts hereinafter described and illustrated in the accompanying drawings of several preferred embodiments in which:

FIG. 1 is a side elevational view of a pipe jewelry ring in accordance with the present invention;

FIG. 2 is a longitudinal cross section of the ring shown in FIG. 1, shown with the cover for the tobacco access opening in an open condition;

FIG. 3 is a perspective view of another embodiment of a jewelry pipe ring in accordance with the present invention;

FIG. 4 is a longitudinal cross section of the ring shown in FIG. 3;

FIG. 5 is perspective view of a ring similar to that shown in FIGS. 3 and 4 but having the access opening facing the direction of the shank to conceal the opening when the ring is worn on a finger;

DESCRIPTION OF THE PREFERRED EMBODIMENTS

Figure 6:
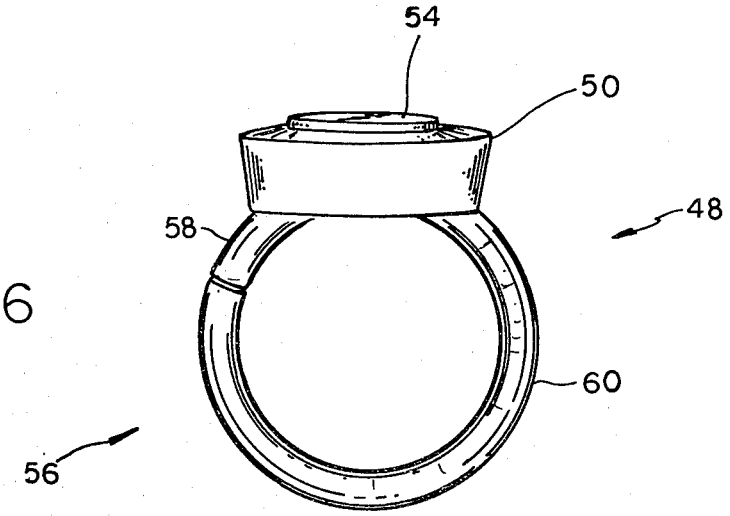
FIG. 6 is a side elevational view of still another embodiment of a pipe ring having a pipe bowl opening cover in the form of a plug, and wherein the shank is hollow and forms part of the conduit means for carrying smoke from the bowl to the mouthpiece.

Referring now specifically to the drawings, in which identical or similar parts are designated by the same reference numerals throughout, and first referring to FIG. 1, one embodiment of a pipe jewelry ring in accordance with the present invention is shown and generally designated by the reference 10.

The pipe ring 10 is in the nature of a smoking device which is both ornamental and functional. The pipe ring 10 includes a pipe tobacco receiving portion or bowl 12 mounted on a ring shank 14 which serves as a mounting means or supporting means for the bowl 12. As with any ring shank, the shank 14 can be dimensioned to permit the ring 10 to be worn on any desired finger.

The tobacco receiving portion or bowl 12 is preferably ornamental and decorative. In FIG. 1, the bowl 12 is shown as turtle figurine having a head 16 and a tail 18. For reasons which will become apparent hereafter, the ornamental bowl 12 may assume any external shape or design which is preferably aesthetically pleasing.

The construction details of the ring 10 are shown in FIG. 2, wherein spaced walls 20 are shown to extend between the head 16 and the tail 18 to form a conduit 22. The conduit 22 is enlarged at one end thereof in the region of the head 16 to form a tobacco receiving cavity 24 for receiving loose smoking tobacco for the purpose of burning the same as with conventional pipes. The other end of the conduit 22 opens at the end of the tail 18 with the latter forming a mouthpiece which may be puffed by the smoker.

In the presently preferred embodiment, the access opening to the cavity 24 may be selectively opened or closed by means of a cover 26 which is pivotally mounted about a horizontally disposed hinge pin 28, as viewed in FIGS. 1 and 2. The cover 26 is also provided with an external shape or design. The external surface configurations of both the bowl 12 and the cover 26 cooperate or have a common theme. The cover 26 serves as camouflaging means for selectively providing access to the cavity 24. The external surfaces of the cover 26 and bowl 12 blend with other when the cover 26 is closed and conceal the access opening to thereby camouflage, even under close scrutiny, the nature of the device as a smoking device. In this way it is not visually discernable when worn as an item of jewelry that the device is also a smoking device. When the cover 26 is closed, as when the ring 10 worn but not being skoked, the access opening and the tobacco receiving cavity 24, as noted, are concealed. This enhances the aesthetic features of the ring 10, as depicted in FIG. 1.

As should be clear, burning of tobacco within the cavity 24 causes the walls 20 to become heated to relatively high temperatures, particularly when hot smoke is drawn through the conduit 22 from the cavity 24 towards the tail 18. Accordingly, while the ornament 30 may be made from any suitable material, it should be made from a material which can be exposed to the anticipated high temperatures without burning, warping or otherwise becoming damaged. For example, ceramics, metals and high temperature molded elastomeric materials may be used for this purpose.

The stem of the pipe ring 10 is formed by the tail 18. This stem may be rigid or flexible and may be permanently fixed to the ornament 30 or may be detachably connected thereto either by means of a pressure fit or threaded engagement with the ornament and walls 20. The feature of detachability is advantageous when the ornament does not naturally include an extension and therefore may not have a pleasing appearance were the stem to be permanently affixed thereto. The same may be true if a permanently attached stem undesireably increases the overall dimensions of the pipe jewelry item to make the same inconvenient to be worn.

In the case of the ring 10, as well as with any other pipe jewelry made of heat conductive bowls which are proximate to the wearer's skin while simultaneously worn and smoked, a thermal insulating layer 32 is advantageously provided between the ornament 30 and the region of the shank 14 or other comparable pipe jewelry support means which contacts or is proximate the user's skin. In FIG. 2, the insulating layer 32 protects the smoker's finger if the ring is simultaneously worn on the latter and smoked. Any conventional thermal insulating material can be used for this purpose. The insulating layer 32 operates to inhibit the flow of heat from the bowl 12, where tobacco combustion takes place, to the surface normally in contact with the wearer of the device.

In the case of the ring 10, as well as with any other pipe jewelry which is proximate to the wearer's skin while simultaneously worn and smoked, a thermal insulating layer 32 is advantageously provided between the ornament 30 and the region of the shank 14 or other comparable pipe jewelry support means which contacts or is proximate the user's skin. In FIG. 2, the insulating layer 32 protects the smoker's finger if the ring is simultaneously worn on the latter and smoked. Any conventional thermal insulating material can be used for this purpose.

The upper portion of the ring 10 is shown to be supported by a base 34 which is connected to the shank 14. While the shank 14 may be permanently connected to wither the upper portion of the ring 10 or to the base 34, such a connection is advantageously such that the ornament 12 is easily detachable from the shank 14 to increase the flexibility of the ring 10 by permitting free interchangeability of ornaments with respect to one single shank. Any suitable connecting means may be used for this purpose. For example, spring clips, screws or the like may be used.

It should be clear from FIGS. 1 and 2 that the dimensions of the tobacco receiving ornament 12 are comparable to those of the shank and, in any event, on the same order of magnitude as the shank to that the ring 10 can be conveniently worn as an item of jewelry.

In FIGS. 3 and 4, another embodiment of the ring 10 is designated by the reference numeral 36 and includes an ornament 38 supported by a shank 40. As with the ring 10, a tobacco receiving cavity 42 is provided with the access opening facing upwardly, as viewed in these FIGURES. A conduit extends longitudinally of the ornament 38 and communicates at one end thereof with the cavity 42. The other end of the conduit opens at the front end 44 of ornament 38. Since the ornament 38 may be at too high a temperature or the front end of the ornament may not be a suitably shaped mouthpiece, a stem and mouthpiece may be inserted into the opening 44 when the ring 36 is to be smoked.

As with the ring 10, a layer of thermal insulating material is advantageously provided to prevent the finger wearing the ring 36 from being exposed to excessive temperatures.

The access opening of the cavity 42 will be visible during normal wear. A cover hinged similarly to cover 26 may be provided to conceal the opening during such wear. A modified version of the ring 36 is shown in FIG. 5 and designated as 36'. Here, the cavity 42' faces downwardly or in the direction of the shank 40. Thus, while the cavity is normally concealed, the ring 36' must normally be taken off the finger to be smoked. This is not true for the ring 10.

Figure 7:
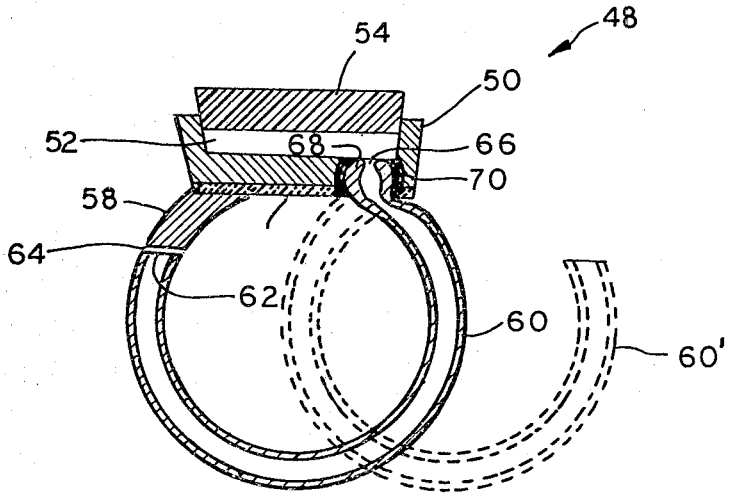
FIG. 7 is a longitudinal cross section of the ring shown in FIG. 6, showing the details of the plug, shank and, in dashed outline, the manner in which the shank is moved from its normal wearing position to the smoking position.

In the rings 10, 36 and 36' thus far described, the shanks are solid and do not serve any function related to the smoking process. The tobacco receiving cavity, the smoke conduit as well as the mouthpiece are all associated with the respective ornaments in these rings The ring 48 shown in FIGS. 6 and 7 differs in this respect from the above described rings.

The ring 48 has an ornament 50 which defines a bowl or tobacco receiving cavity 52 whose access opening can be closed by means of a cover or plug 54. The plug 54 may be received within the cavity 52 in pressure relation, as a cork within a bottle, or in any other suitable way, such as with screw threads. It should be clear that a plug similar to plug 54 may be used in conjunction with cavities 42 and 42' in respective rings 36 and 36'.

The ornament 50 is mounted on a shank generally indicated by the number 56. The shank 56 may include a solid arcuate section 58 connected to the ornament 50 in a fixed relation thereto. An important feature of this embodiment is that the balance of the shank 56 is in the form of a hollow or tubular member which serves as the smoke conduit and mouthpiece. The mouthpiece forms one free open end of the tubular member 60 and is indicated at 62. When the tubular member 60 is in the normal, solid position, the mouthpiece 62 may be separated by a space 64 from the arcuate section 58 and in opposition to the latter to conceal the mouthpiece opening. A spring clip (not shown) or other suitable means may be utilized to lock the position of the tubular member when the same is only worn and not used to smoke the pipe ring 48.

To permit movement of the tubular member 60 to the position 60' shown in dashed outline, the other free end of the tubular member must be suitably mounted. This is necessary to expose the mouthpiece 62 and to smoke the pipe ring 48. To use the tubular member 60 as a smoke conduit, the end thereof 68 directly coupled to the ornament 50 must be maintained in air flow communication with the cavity 52 in all anticipated smoking positions of the member 60.

In the presently preferred embodiment, the member 60 is connected to the ornament 50 by means of a ball and socket joint. The free end of the member 60 is rounded, at 68 into a ball or spherical shape. A socket 70 is embedded within the ornament 50 and received the rounded end of the member 60 with some clearance to permit movement of the member 60 relative to the ornament, as suggested in FIG. 7.

Since member 60, a part of the shank 56, must be moved and thereby opening the circular nature of the shank, the pipe ring 48 is not intended to be worn during smoking as with the prior described rings. Accordingly, the insulating layer 72 is optional and primarily serves to protect the smoker's skin should he place the ring on his finger soon after smoking while the ornament is still at a high temperature.

Figure 8:
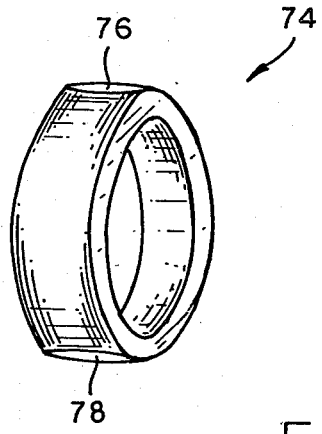
FIG. 8 is a perspective view of yet another embodiment of the present invention which may be dimensioned to be worn either as a ring or as a bracelet.
Figure 9:
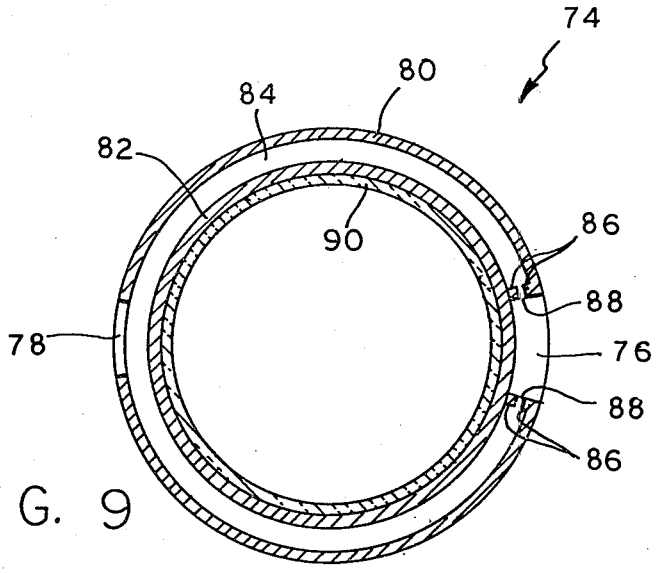
FIG. 9 is an enlarged longitudinal cross section of the ring shown in FIG. 8.

A jewelry smoking device construction suitable for rings as well as bracelets is shown in FIGS. 8 and 9. For the purpose of description, the item designated as 74 will be termed a bracelet. The bracelet 74 is generally in the form of a hollow annular member provided with two diametrically opposing openings 76 and 78 each in communication with the central hollow portion of the member.

The hollow, annular member is formed by an outer annular wall 80 and an inner annular wall 82 as shown in FIG. 9. The two concentric spaced walls 80 and 82 together define the smoke conduit 84 which extends between the openings 76 and 78. Stop means, which may similarly be incorporated into the other embodiments, may be in the form of projections 86 which define restricted spaces 88 which permit the passage of smoke into the conduit 84 but prevent the passage of tobacco or ashes or the like into the same. A fine wire mesh net may also be used for this purpose.

The tobacco is deposited into the opening or cavity 76 and the smoke is puffed at opening 78. As with the rings 36 and 36', a stem may be coupled to the opening 78 in order to provide a more suitable mouthpiece.

Since the bracelet may be worn around the hand while the same is smoked, an insulating layer 90 is advantageously provided for the above mentioned reasons.

While the above description is only with reference with pipe rings and pipe bracelets, it should be clear that the specific nature of the item of jewelry is not critical and that the basic above described principles may also be applied to necklace pendants, tie clasps, earings, and the like without departing from the spirit of the present invention.

It is also contemplated that a telescopic stem may be provided which forms part of an ornament, such as the tail 18 in FIG. 1, so that the mouthpiece may be disposed as close or as far from the ornament as desired. However, such a telescopic stem, as other stems, may be in the nature of an accessory or attachment which may be coupled to a smoke conduit.

Numerous alterations of the structure herein disclosed will suggest themselves to those skilled in the art. However, it is to be understood that the present disclosure relates to preferred embodiments of the invention which are for illustration only and are not to be construed as limitations of the invention.

What is claimed is:

1. A combination jewelry and pipe smoking device comprising a tobacco receiving portion for receiving loose smoking tobacco; a mouthpiece portion; a conduit portion extending between said tobacco receiving and mouthpiece portions for conducting smoke from the former to the latter; mounting means for mounting the device on the body of the wearer and defining surfaces which normally comes into contact with the body of the wearer when said device is being smoked, whereby the jewelry and smoking device may be worn as an item of jewelry while smoking the same and may be smoked after being removed and manually supported subsequent to removal of the same from the wearer; insulating means in the nature of an insulating material associated with at least one of said surfaces for reducing the flow of heat from said tobacco receiving portion to said surface and for protecting the wearer from the heat developed in the device during smoking a mouthpiece portion; a conduit portion extending between said tobacco receiving and mouthpiece portions for conducting smoke from the former to the latter; said tobacco receiving portion having an external surface configuration providing a visual illusion of a smoking device; and camouflaging means having an external surface which forms part of and blends with said external surface configuration of said tobacco receiving portion for camouflaging the nature of the device as a smoking device and providing a visual illusion of a device other than a smoking device, whereby it is not visually discernable when worn as an item of jewelry that the device is also a smoking device.

2. Smoking device as defined in claim 1, wherein said mounting means is in the general form of a ring shank dimensioned to be worn on a person's finger, said tobacco receiving portion being mounted on said shank and having an open cavity therein for receiving tobacco.

3. Smoking device as defined in claim 2, wherein said tobacco receiving portion is an ornamental structural shape and wherein said conduit and mouthpiece portions form part of said structural shape, whereby the smoking device may be smoked by puffing on a portion of said structural shape which forms a mouthpiece portion while the ring is still worn on a finger.

4. Smoking device as defined in claim 2, wherein said shank includes a tubular portion having two open ends, one of said open ends being in communication with said cavity, whereby said conduit portion and said mouthpiece portion is in the other of said two open ends.

5. Smoking device as defined in claim 1, wherein said tobacco receiving portion has an opening; and further comprising camouflaging means for selectively providing access to said opening and for covering the same and concealing, even under close scrutiny, the nature of the device as a smoking device when the same is not being smoked, whereby it is not visually discernable when worn as an item of jewelry that the device is also a smoking device.

6. Smoking device as defined in claim 5, wherein said camouflaging means is in the form of a hinged cover.

7. Smoking device as defined in claim 5, wherein said camouflaging means is in the form of a plug receivable within said opening.

8. Smoking device as defined in claim 1, wherein said stem portion is rigid over its length.

9. Smoking device as defined in claim 1, wherein said tobacco receiving portion is removably mounted on said mounting means, whereby different tobacco receiving portions may be interchangeably mounted on a single mounting means.

10. Smoking device as defined in claim 1, wherein said mounting means is in the form of an annular hollow member, one opening being provided at one circumferential portion of said annular member and another opening being provided at another circumferential portion spaced from said opening, one of said openings forming said tobacco receiving portion and the other one of said openings forming said mouthpiece portion.

11. Smoking device as defined in claim 10, wherein said openings are disposed on diametrically opposite portions of said annular member.

* * * * *